US007212753B2

(12) United States Patent
Suzuki et al.

(10) Patent No.: US 7,212,753 B2
(45) Date of Patent: May 1, 2007

(54) IMAGE FORMING APPARATUS AND PROCESS CARTRIDGE

(75) Inventors: Hirokatsu Suzuki, Chiba (JP); Hiroshi Nakai, Kanagawa (JP); Hideki Kosugi, Kanagawa (JP); Ichiro Kadota, Tokyo (JP); Jun Yura, Kanagawa (JP); Koichi Katoh, Kanagawa (JP); Kei Yasutomi, Kanagawa (JP); Kazumi Suzuki, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 203 days.

(21) Appl. No.: 11/030,158

(22) Filed: Jan. 7, 2005

(65) Prior Publication Data

US 2005/0152707 A1 Jul. 14, 2005

(30) Foreign Application Priority Data

Jan. 8, 2004 (JP) ..... 2004-002879

(51) Int. Cl.
*G03G 15/08* (2006.01)

(52) U.S. Cl. ..... 399/27

(58) Field of Classification Search ..... None
See application file for complete search history.

(56) References Cited

U.S. PATENT DOCUMENTS 4,914,459 A * 4/1990 Mama et al. ..... 347/133
5,021,828 A * 6/1991 Yamaguchi et al. ..... 399/24
2001/0030680 A1* 10/2001 Mitsuya et al. ..... 347/115
2005/0152707 A1 7/2005 Suzuki et al.

FOREIGN PATENT DOCUMENTS

| | | |
|---|---|---|
| JP | 9-190075 | 7/1997 |
| JP | 2000-118036 | 4/2000 |
| JP | 2001-51501 | 2/2001 |
| JP | 2002-196526 | 7/2002 |
| JP | 2003-54026 | 2/2003 |
| JP | 2003-57864 | 2/2003 |

OTHER PUBLICATIONS

U.S. Appl. No. 11/450,470, filed Jun. 12, 2006, Kadota et al.

* cited by examiner

*Primary Examiner*—Vincent Q. Nguyen
(74) *Attorney, Agent, or Firm*—Oblon, Spivak, McClelland, Maier & Neustadt, P.C.

(57) ABSTRACT

An image forming apparatus includes an image carrier; an exposing unit that exposes the image carrier to light to form an electrostatic latent image on the image carrier; a developing unit that has at least a toner, and develops the electrostatic latent image formed on the image carrier as a toner image; a transfer unit that transfers the toner image onto a recording medium; a fixing unit that fixes the toner image transferred on the recording medium; an exposure-energy modulating unit that modulates exposure energy of the exposing unit; and a development-time detecting unit that detects operation time of the developing unit. The exposure-energy modulating unit modulates the exposure energy based on a result of detection by the development-time detecting unit.

13 Claims, 5 Drawing Sheets

FIG. I

IMAGE FORMING APPARATUS AND PROCESS CARTRIDGE

CROSS-REFERENCE TO RELATED APPLICATIONS

The present document incorporates by reference the entire contents of Japanese priority document, 2004-002879 filed in Japan on Jan. 8, 2004.

BACKGROUND OF THE INVENTION

1) Field of the Invention

The present invention relates to an image forming apparatus like a copying machine, a printer, a plotter, or a facsimile and a process cartridge used in the image forming apparatus.

2) Description of the Related Art

In recent years, image forming apparatuses like a copying machine and a printer have been widespread in the market. A color image forming apparatus is also being widespread in the market in accordance with colorization of documents.

In an electrophotographic system that is widespread as a system for an image forming system, a process described below is executed as a representative image forming process. First, a photosensitive member serving as an image carrier is uniformly charged by a charger and, then, exposure corresponding to image information is applied to the charged photosensitive member to cause a potential difference between a non-image portion and an image portion. Then, toner particles are deposited only on the image portion by a developing unit to form a toner image, which is transferred onto a recording medium such as recording paper or an OHP sheet directly or via an intermediate transfer member. When a color image is formed, toner images of respective colors are superimposed one on top of another by various publicly known methods. For example, the image forming process described above is carried out for each color to sequentially form color images of respective colors on a photosensitive member, and the toner images are sequentially transferred on to a recording medium directly or via an intermediate transfer member. Alternatively, toner images of plural colors are formed one on top of another on a photosensitive member to transfer the toner images collectively on to a recording medium directly or via an intermediate transfer member. Alternatively, toner images of respective colors are formed on plural photosensitive members, respectively, and the toner images are superimposed on a recording medium directly or via an intermediate transfer member at the time of transfer. A single color toner image or a color toner image formed on the recording medium is fixed on the recording medium in a fixing unit.

Incidentally, compared with the single color image, the color image is often colored in a background portion as well, which tends to increase a quantity of toner to be consumed for forming one image. The increase in a quantity of toner consumption is unfavorable from the viewpoint of a reduction in an environmental load.

From the viewpoint of an image quality, when a large quantity of toner is deposited on one pixel, a toner layer thickness per one pixel increases. Thus, dust of the toner tends to scatter when a toner image is transferred, and a dot area of the toner image tends to increase when the toner image is fixed. These phenomena occur even in the single color image and occur particularly conspicuously in the color image. As a result, sharpness of the images is hindered, which leads to deterioration of image qualities.

Moreover, in the color image, the number of colors of toners deposited on one pixel is different for each pixel. Thus, a thickness of a toner layer changes for each pixel and a rate of increase in the dot area also changes when the toner image is fixed. When a dot area per one pixel varies, granularity of an image worsens, that is, the image is roughened, which leads to deterioration of the image quality.

As conventional technologies for improvement of granularity according to a control of exposure energy, various systems are disclosed in, for example, Japanese Patent Application Laid-Open No. 2000-118036 and Japanese Patent Application Laid-Open No. 2003-54026. In the system disclosed in Japanese Patent Application Laid-Open No. 2000-118036, output energy of a light beam of an exposure device is controlled taking notice of optical potential attenuation characteristics of a photosensitive member. In the system disclosed in Japanese Patent Application Laid-Open No. 2003-54026, an exposure pattern is selected and used in a highlight portion.

On the other hand, when a developing unit is used for a long period of time, a toner inside the developing unit deteriorates due to mechanical and thermal stresses. In particular, an extraneous additive like silica coating the toner is buried in the toner surface or separated from the toner due to the stresses. This causes a problem in that charging characteristics and flow characteristics of the toner change and an image quality deteriorates. To cope with this problem, a system for preventing aged deterioration of a toner by specifying a shape and a particle diameter of an extraneous additive is proposed as disclosed in Japanese Patent Application Laid-Open No. 2002-196526 and Japanese Patent Application Laid-Open No. 2003-057864.

As effective means for improving an image quality, it is possible to reduce a quantity of toner to be deposited per a unit area of an image portion. In the following description, a weight of toner to be deposited per a unit area of an image portion is called M/A, which is used as a characteristic representing a quantity of toner to be deposited per the unit area.

The reduction in a quantity of deposited toner leads to a reduction in a quantity of toner consumption and a reduction in an environmental load. In addition, the-transfer dust and the increase in a dot area at the time when a toner image is fixed are controlled through the reduction in the quantity of deposited toner, and a dot area difference among pixels is also reduced. Moreover, deficiencies like deformation and curl of a recording medium due to a thickness of a toner layer are also reduced significantly. From such viewpoints, the applicant has been studied an improvement of an image quality and the like at the time when a quantity of deposited toner is reduced.

However, while the applicant carried forward the examination, the applicant noticed that, in an image forming process with a reduced quantity of deposited toner, granularity of an image deteriorated noticeably as an image forming apparatus was used longer, and an initial image quality could not be maintained. In particular, the applicant found that, as an image quality that changed with time, granularity in a highlight portion worsened compared with the initial image quality of the image forming apparatus.

The applicant observed a toner in a developing unit when the toner is in an initial period and when the toner is aged using an electron microscope (SEM). Then, although a state in which an extraneous additive coated the toner surface was observed in the initial toner, no extraneous additive was observed on the toner surface in the aged toner. This indicates that the extraneous additive was buried in or separated from the toner surface in the aged toner due to mechanical and thermal stresses as explained above concerning the conventional technologies.

The applicant carried out an experiment described below to investigate how the aged toner, in which the extraneous additive was buried or from which the extraneous additive was separated, affected an image quality.

First, the applicant prepared two types of developing units in an initial state and an aged state and set the developing units in an image forming apparatus to output images. In the developing unit in the aged state, in which a developer is inside the developing unit, images are created in an accelerated manner by idling of the developing unit with a single driving device for 120 minutes. In this case, the applicant sampled the toner and observed a coating state of the extraneous additive using the electronic microscope. Then, the applicant confirmed that a state of the toner surface was the same as that of the aged toner in the state in which the extraneous additive was buried in the toner surface or separated from the toner surface described above.

As image forming conditions, a resolution was set to 1200 dots/inch (dpi), a charging potential was set to −630 volts, a developing bias was set to −500 volts, a toner diameter was set to 5.5 micrometers, and a carrier diameter was set to 35 micrometers. Conditions for the experiment were set such that a quantity of deposited toner per a unit area M/A in a solid image on paper (a state in which a toner was deposited over the entire surface of the paper) was 0.45 mg/cm$^2$.

Here, assuming that granularity, which was roughness of an image, was caused by fluctuation in a dot area in a half-tone dot, the applicant evaluated the fluctuation in the dot area to use the fluctuation as substitute for the granularity. In addition, to check contribution of deterioration in an image quality in respective processes, as evaluation of images, the applicant evaluated a dot image on a photosensitive member after development, a dot image on an intermediate transfer member after transfer, and a dot image on paper after fixing, respectively. In the evaluation of a dot area, the applicant photographed dot images in the respective processes using a digital microscope and binarized the images to thereby obtain respective dot areas in the half-tone dot. The applicant evaluated a standard deviation of the dot areas as an amount of fluctuation in the dot areas.

FIG. 6 shows an evaluation result in this case. The horizontal axis indicates the respective processes, and "after development", "after transfer", and "after fixing" represent an image on a photosensitive member, an image on an intermediate transfer member, and an image on paper after fixing. In addition, the vertical axis indicates a standard deviation σ representing fluctuation in a dot area. From FIG. 6, it is seen that a difference between an initial toner and an aged toner increases after transfer, which indicates that deterioration in an image quality is large in a transfer process when the aged toner is used. Consequently, it is considered that this deterioration in an image quality is promoted even after fixing to worsen granularity.

The applicant assumes a mechanism as described below concerning the deterioration in an image quality in the transfer process of a toner (aged toner) in which the extraneous additive is buried or from which the extraneous additive is separated from. Since the aged toner is coated with the extraneous additive in a small area on the toner surface compared with the initial toner, it is estimated that a non-electrostatic adhesive force of the toner adhering with the photosensitive member is large. Thus, although transfer efficiency falls, usually it is possible to adjust the transfer efficiency according to conditions like a transfer bias. However, in this case, the transfer efficiency is mainly adjusted using a pattern with a large quantity of deposited toner like a solid image. In this experiment, for the initial toner and the aged toner, transfer conditions are already adjusted such that a quantity of deposited toner in a solid portion on paper is fixed. However, since a dot image in a highlight portion has a transfer characteristic different from that in the solid portion, it is considered that proper transfer efficiency is not obtained.

The applicant considers the difference in transfer efficiency according to an image pattern as follows. It is found in conventional measurement or the like that a toner layer consisting of about two to three layers is formed in the toner image on the photosensitive member after development. Since a transfer electric field is applied in the transfer process, a force moving from the photosensitive member in a direction of the intermediate transfer member acts on the toner on the photosensitive member. In this case, the toner image is required to be at least electrostatically transferred with a force stronger than an adhesive force between the photosensitive member and the toner such that the toner is transferred entirely. Here, a simple model as described below is devised. First, in the case of the solid image, in the toner image on the photosensitive member, it is assumed that a toner layer in contact with a photosensitive member (OPC) is A, and a toner layer on the toner layer A is B as shown in FIG. 7A. When the toner layer shown in FIG. 7A is considered, an adhesive force between toners acts on the toner layer A and the toner layer B, and an adhesive force between a toner and a photosensitive member acts on the toner layer A and the photosensitive member (OPC). Usually, a non-electrostatic component is large in the latter adhesive force. Therefore, when the transfer electric field is weak or when a non-electrostatic force is large, the toner layer A portion remains on the photosensitive member in a large quantity. In other words, since the non-electrostatic force is large in the aged toner, a quantity of transfer residual toner in the toner layer A portion is large. Therefore, adjustment is performed such that a target quantity of solid deposited toner by intensifying the transfer electric filed or increasing an input quantity of deposited toner (toner layer B portion). However, it is well known that, to the contrary, application of an excessive transfer electric field deteriorates the transfer efficiency and causes deficiencies like scattering of a toner. Thus, it is necessary to set a quantity of solid deposited toner taking into account a target quantity of deposited toner and a target transfer rate in advance.

On the other hand, in the case of the dot image in the highlight portion, an area of the dot image is reduced and, unlike the solid image, an edge portion of the dot image affects the toner image on the photosensitive drum. Thus, it is considered that the toner layer B has an angle shape as shown in FIG. 7B in the toner image on the photosensitive drum. Although the same action as that in the solid portion acts in the transfer process, when the toner deteriorates and a non-electrostatic adhesive force increases, even if the toner layer is increased at the same rate as that in the solid image, an amount of the increase is small because the toner layer B has the angle shape. Thus, in the aged toner, even if there is a sufficient amount of solid image on paper, a quantity of transferred toner is not sufficient in the highlight dot image. It is considered that this worsens granularity with time.

SUMMARY OF THE INVENTION

It is an object of the present invention to solve at least the above problems in the conventional technology.

An image forming apparatus according to one aspect of the present invention includes an image carrier; an exposing unit that exposes the image carrier to light to form an electrostatic latent image on the image carrier; a developing unit that has at least a toner, and develops the electrostatic latent image formed on the image carrier as a toner image; a transfer unit that transfers the toner image onto a recording medium; a fixing unit that fixes the toner image transferred on the recording medium; an exposure-energy modulating unit that modulates exposure energy of the exposing unit; and a development-time detecting unit that detects operation time of the developing unit. The exposure-energy modulating unit modulates the exposure energy based on a result of detection by the development-time detecting unit.

A process cartridge according to anther aspect of the present invention is mounted on an image forming apparatus that includes an image carrier; an exposing unit that exposes the image carrier to light to form an electrostatic latent image on the image carrier; a developing unit that has at least a toner, and develops the electrostatic latent image formed on the image carrier as a toner image; a transfer unit that transfers the toner image onto a recording medium; a fixing unit that fixes the toner image transferred on the recording medium; an exposure-energy modulating unit that modulates exposure energy of the exposing unit; and a development-time detecting unit that detects operation time of the developing unit. The exposure-energy modulating unit modulates the exposure energy based on a result of detection by the development-time detecting unit. The process cartridge supports the image carrier and at least one of a charging unit, the developing unit, and a cleaning unit integrally, and is detachably mounted on a main body of the image forming apparatus.

The other objects, features, and advantages of the present invention are specifically set forth in or will become apparent from the following detailed description of the invention when read in conjunction with the accompanying drawings.

DETAILED DESCRIPTION

Exemplary embodiments of an image forming apparatus and a process cartridge according to the present invention will be explained in detail with reference to the accompanying drawings.

Figure 1:
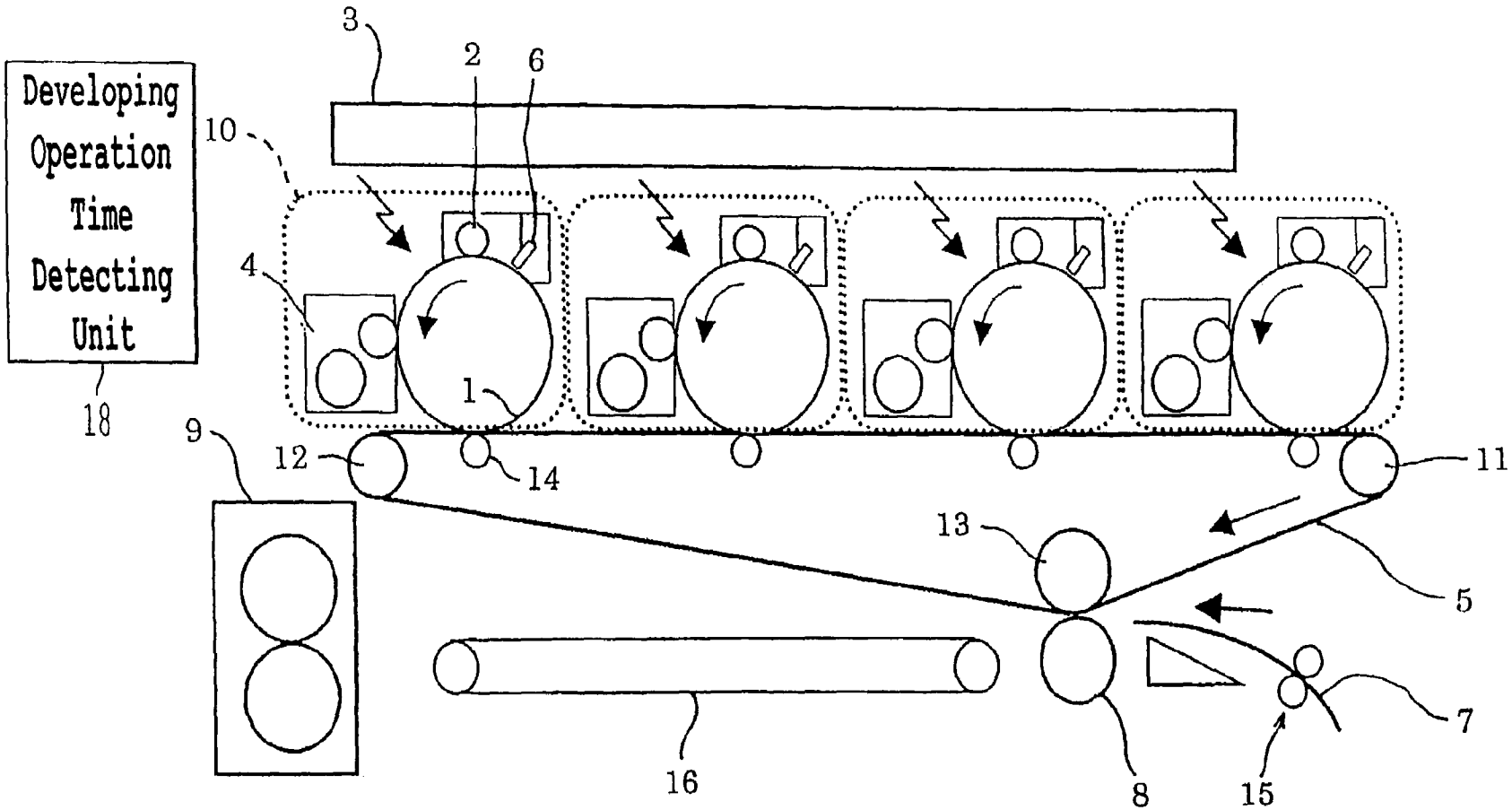
FIG. 1 is a diagram of an embodiment of the invention and is a schematic diagram of an image forming apparatus including a process cartridge.

FIG. 1 is a diagram of an embodiment of the invention and is a schematic diagram of an image forming apparatus including a process cartridge.

A color image forming apparatus shown in FIG. 1 is a color image forming apparatus of a so-called tandem system. The color image forming apparatus has a structure in which process cartridges (image forming units) 10 of respective colors of, for example, yellow, magenta, cyan, and black are arranged in series in a moving direction of an intermediate transfer member. The process cartridges 10 of the respective colors have the same structure in which a charging device 2, a developing unit 4, a cleaning device 6, and the like are arranged around a photosensitive member 1 of a drum shape serving as an image carrier. In addition, an exposing unit 3 and an intermediate transfer member 5 of an intermediate transfer device are arranged for the photosensitive members 1 of the respective process cartridge 10. Besides, the color image forming apparatus includes a sheet conveying units (a registration roller 15, a conveyor belt 16, etc.), a sheet transfer device 8, and a fixing unit 9. The intermediate transfer member 5 of the intermediate transfer device is an intermediate transfer belt of an endless belt shape. This intermediate transfer belt 5 is supported by three support rollers 11 to 13 to be rotated in a direction of arrow in the figure. Note that one of the support rollers 11 to 13 is a drive roller and the other support rollers are driven rollers. Transfer bias application rollers 14 are disposed on a rear side of the intermediate transfer belt 5 in positions opposed to the photosensitive members 1, respectively. In the invention, components that are plural in number among the components such as the photosensitive member 1, the charging device 2, the developing unit 4, and the cleaning device 6 are combined and constituted integrally as the process cartridge 10. This process cartridge 10 is constituted to be detachably attachable to an image forming apparatus body of a copying machine, a printer, or the like.

In the image forming units of the respective colors, the photosensitive members 1 serving as image carriers are driven to rotate in an arrow direction in the figure, and surfaces thereof are uniformly charged by the charging devices 2. Then, the photosensitive members 1 are exposed to light by the exposing unit 3 that is driven to light based on an image signal, whereby electrostatic latent images are formed on the photosensitive members 1. Toner images of the respective colors are formed on the photosensitive members 1 according to the electrostatic latent images in the developing units 4 of the respective colors of yellow, magenta, cyan, and black. The toner images of the respective single colors formed on the photosensitive units 1 of the respective image forming units are sequentially transferred onto the intermediate transfer belt 5 of the intermediate transfer device, whereby the toner images of the respective single colors are superimposed on the intermediate transfer belt 5. In addition, toners, which are not transferred onto the intermediate transfer belt 5 and remain on the photosensitive drums 5, are collected by the cleaning devices 6. On the other hand, a sheet 7 serving as a recording medium is fed from a sheet cassette (not shown) storing the sheet 7, and conveyed to the sheet transfer device 8 by a registration roller 17 serving as a sheet conveying unit. Then, the toner images of the four colors superimposed on the intermediate transfer belt 5 are collectively transferred onto the sheet 7 by the sheet transfer device 8. The sheet 7 after the transfer is conveyed to the fixing unit 9 by the conveyor belt 16 and the toner images on the sheet 7 are thermally fixed by the fixing unit 9, whereby a color image is obtained.

The photosensitive member 1 is a stacked electrophotographic photosensitive member in which a photosensitive layer is provided on a conductive support member (conductive base). This photosensitive layer is formed by a lamination of a charge generation layer containing a charge generation material as a main component and a charge transport layer containing a charge transport material as a main component. A protective layer or the like is also formed as a surface layer of the photosensitive member 1. In this embodiment, a total thickness of the photosensitive member 1 is 20 micrometers and, in particular, a thickness of the charge transport layer is 15 micrometers.

Toner particles are obtained by fusing and milling a mixture, which consists at least of binding resin, a coloring agent, and a releasing agent, with a heat roll mill and, then, cooling and setting the mixture, and mixing and bonding an additive to parent body particles, which are obtained by grinding and classifying the mixture, with a high speed mixer or the like. As the binding resin and the coloring agent in this case, all those conventionally used as binding resin for a toner are applied. As the binding resin, binding resin indicating a softening point of 90° C. to 150° C., a glass transition temperature of 50° C. to 70° C., a number average molecular weight of 2000 to 6000, and a weight average molecular weight of 8000 to 150000 is particularly preferable. As a content of the coloring agent in the toner particles, a range of about 2% to 12% is optimum taking into account the balance of coloring power and maintenance of a charging property. On the other hand, as the releasing agent, all publicly known releasing agents can be used. However, in particular, it is preferable to use carnauba wax, montan wax, and oxide rice wax individually or in combination. As a quantity of use of the releasing agent, a range of 1% to 10% with respect to a quantity of a toner resin component is advisable. As an average volume particle diameter of the releasing agent before the releasing agent is dispersed into a toner binder, in particular, a range of 10 micrometers to 300 micrometers is preferable. In addition, as an additive to be externally added to the toner particles, an inorganic fine particular matter like titanium oxide or silica is preferable and has an effect of realizing more efficient charging. Note that a manufacturing method of the toner is not limited to the grinding method, and a polymerization method like an emulsion polymerization method or a dissolving suspension method may be used.

Figure 2:
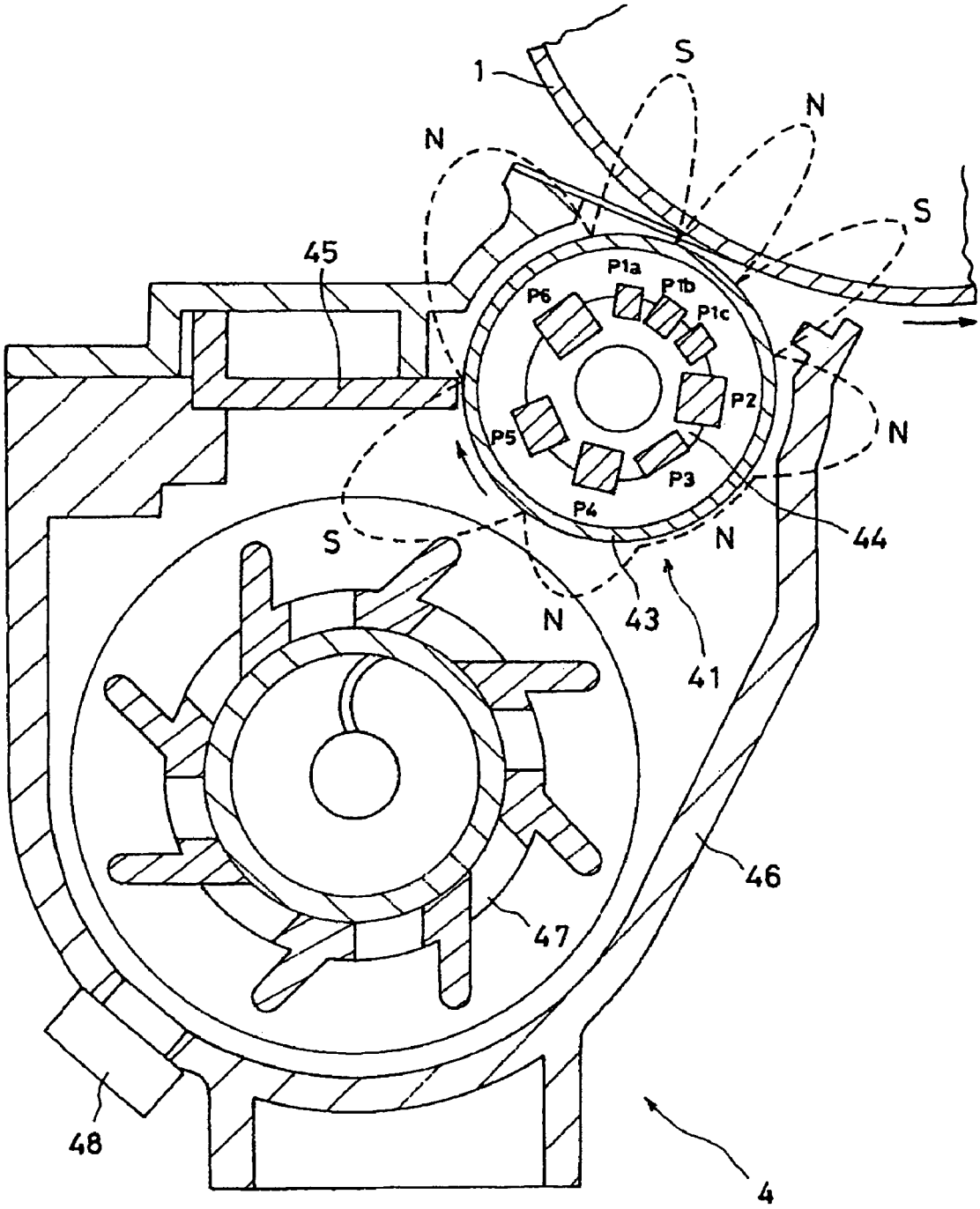
FIG. 2 is a schematic sectional view of an example of a structure of a developing unit that is used for an image forming apparatus according to the invention.

Next, an example of a structure of the developing unit 4 used for the image forming apparatus of the invention will be explained with reference to FIG. 2. A developing roller 41 serving as a developer carrying member is arranged to be contiguous with the photosensitive member 1 serving as an image carrier such that a development area is formed in a part where the developing roller 41 and the photosensitive member 1 are opposed to each other. A developing sleeve 43, which is constituted by forming a non-magnetic body like aluminum, brass, stainless steel, or conductive resin in a cylindrical shape, is provided in the developing roller 1 to be rotated in an arrow direction in the figure (clockwise direction) by a not-shown rotation drive mechanism. A magnetic roller member 44, which forms a magnetic field to stand a developer like the ears of rice on the surface of the developing sleeve 43, is provided in the developing sleeve 43 in a fixed state. The developer contained in the developing unit is a two component developer consisting of a toner and a magnetic carrier. The carrier forming the developer is stood like the ears of rice in a chain shape on the developing sleeve 43 to be in parallel to magnetic lines of force emitted from the magnetic roller member 44. A charged toner adheres to this carrier stood like the ears of rice in the chain shape to form a magnetic brush. The formed magnetic brush is carried in the same direction as the developing sleeve 43, that is, the clockwise direction in accordance with the rotation and transfer of the developing sleeve 43. A doctor blade 45, which regulates a height of the developer chain ears, that is, a quantity of the developer, is set in an upstream side portion of the development area in the carrying direction of the developer, that is, the clockwise direction. Moreover, a screw 47, which draws the developer in a developing casing 46 to the developing roller 41 side while agitating the developer, is set in a rear area of the developing roller 41. In addition, a concentration sensor 48, which detects a toner concentration in the developer, is provided on a casing wall surface below the screw 47. Besides, a toner supply unit, which supplies the toner to the developing unit 4, and the like are provided in the developing unit 4. However, the units are not shown in the figure.

Figure 3:
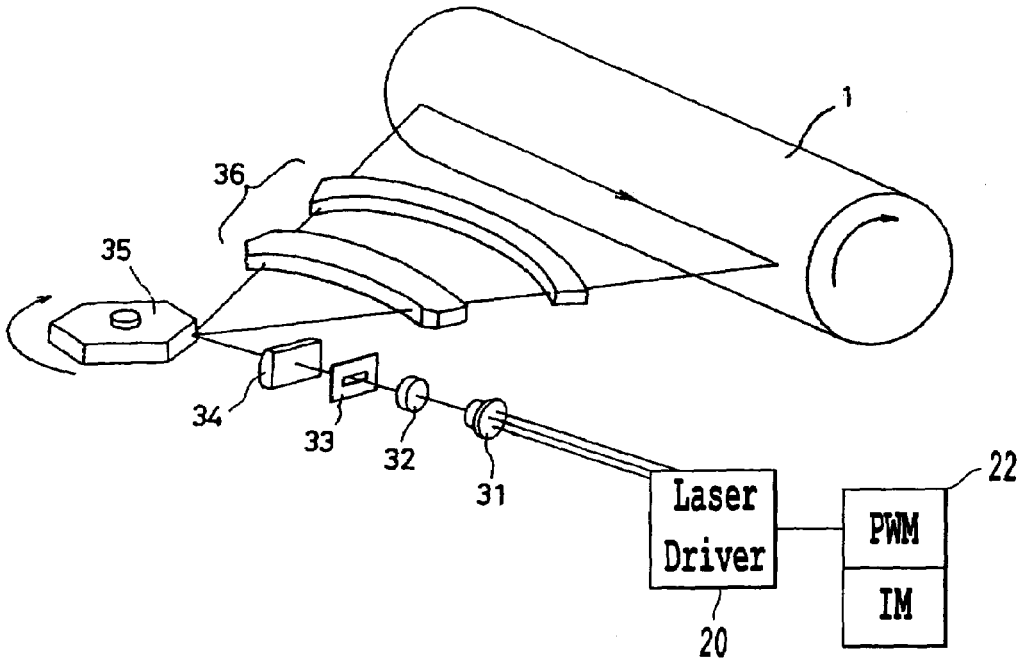
FIG. 3 is a schematic diagram of a laser scanning optical system of an example of an exposing unit.

Next, an example of a structure of the exposing unit 3 used for the image forming apparatus of the invention will be explained with reference to FIG. 3. As shown in FIG. 3, the exposing unit 3 includes a so-called laser scanning optical system including a laser emission element 31 serving as a light source, a collimator lens 32, an aperture 33, a cylindrical lens 34, a polygon mirror 35, and an f-θ lens 36. This laser scanning optical system is provided in association with the photosensitive members 1 for the respective colors. A light beam emitted from the laser emission element 31 is changed to parallel light fluxes by the collimator lens 32 and passes the aperture 33 to be made incident on the cylindrical lens 34. The light beam is condensed in a sub-scanning direction by the cylindrical lens 34 and made incident on the polygon mirror 35. The light beam is used for scanning in a main scanning direction, which is parallel to a rotation axis direction of the photosensitive members 1, by the polygon mirror 35. The light beam used for scanning in the main scanning direction is adjusted by the f-θ lens 36 such that a scanning angle and a scanning distance are proportional to each other and is condensed in the sub-scanning direction to be focused on the photosensitive members 1.

Note that when the laser scanning optical system is used, it is possible to change a recording density of an image easily by changing a rotation velocity of the polygon mirror 35 and changing a clock of laser irradiation in the main scanning direction. In addition, it is also possible to change a recording density by changing a linear velocity of the photosensitive members 1 instead of changing the rotation velocity of the polygon mirror 35. The laser emission element 31 is connected to laser driver 20, which generates a light emitting signal for laser beam generation, to perform a blinking operation. Note that the laser emission element 31 may have a so-called multi-beam structure in which plural laser emission elements are arranged in parallel.

The laser driver 20 is connected to an exposure energy modulation unit 22 including a pulse width modulation (PWM) unit and an intensity modulation (IM) unit. The pulse width modulation (PWM) unit controls an emission time of laser. More specifically, it is possible to form a desired pulse width signal by comparing a triangular wave signal and an image signal using a comparator. On the other hand, the intensity modulation (IM) unit controls intensity of a laser beam. The intensity modulation (IM) unit forms an intensity signal for setting a current value to be inputted to the laser emission element 31 according to the image signal. Therefore, in the exposure energy modulation unit 22, the pulse width signal and the intensity signal are sent to the laser driver 20 according the image signal. For example, when an input image has 4 bits, it is possible to set exposure energy in sixteen stages by combining pulse width signals and intensity signals. A method of setting exposure energy depends on the laser driver 20. For example, pulse width modulation is set to 2 bits and intensity modulation is set to 2 bits, and these bits are arranged in a table with respect to the image signal, whereby it is possible to perform modulation.

Figure 4A:
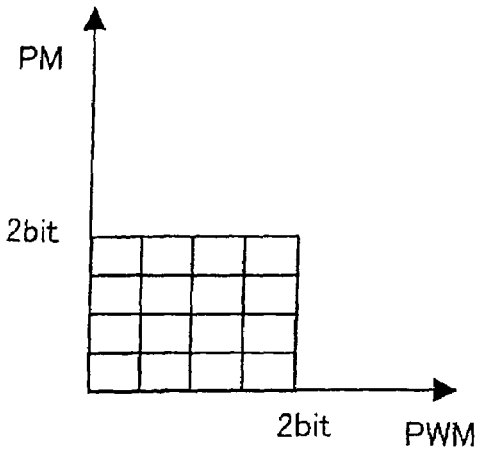
FIGS. 4A and 4B are diagrams of examples of a table for exposure energy modulation.
Figure 4B:
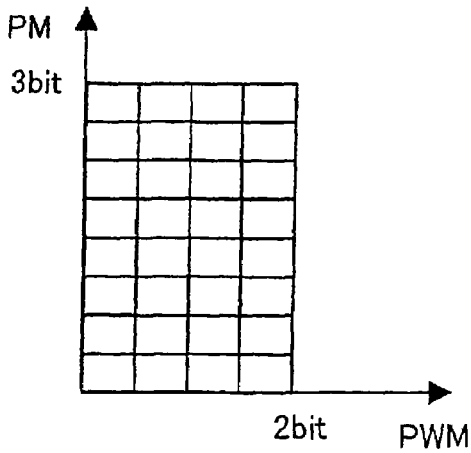

This embodiment is characterized in that plural tables for exposure energy modulation are provided in a memory of a not-shown control unit (a body main control board including a microcomputer, a memory, various control circuits, a clock, a counter, and input and output ports), and the tables are applied selectively according to an input image. This will be explained more specifically with reference to FIG. 4. In the modulation of exposure energy in this embodiment, the pulse width modulation (PWM) is set to 2 bits and the intensity modulation (IM) is set to 3 bits, and it is possible to modulate the exposure energy in the respective ranges. Here, as an example of the table for exposure energy modulation, tables in which the pulse width modulation (PWM) is fixed at 2 bits and the intensity modulation (IM) direction is set to 2 bits and 3 bits are provided as shown in FIGS. 4A and 4B. The table in FIG. 4A is referred to as a table (A) and the table in FIG. 4B is referred to as a table (B). In a normal case (without deterioration of a toner), an image is created using the table (A). When the toner deteriorates and granularity of a highlight portion worsens, the table (B) is applied only to creation of an image of the highlight portion, and the usual table (A) is used as it is for a pattern with a large quantity of deposited toner like a solid image. Consequently, even when the toner deteriorates and granularity of the highlight portion worsens, it is possible to increase only a quantity of deposited toner in the highlight portion, where the quantity of deposited toner has decreased, efficiently without increasing an entire quantity of used toner. In this case, this processing is applied when an area ratio in an input image is 25% or less as the highlight portion, whereby it is possible to increase only the quantity of deposited toner in the highlight portion efficiently. Note that it is not preferable to apply the processing when an area ratio is larger than that because discontinuity of an image concentration in a gradation portion is conspicuous and a reduction in a quantity of used toner cannot be realized. In addition, the number of tables and the number of modulations are not limited to those in this embodiment. It is possible to perform more precise control by increasing the number of tables.

A development drive signal is emitted from the not-shown control unit (body main control board), which performs overall control of operations of the image forming apparatus, to a development drive motor. The developing operation time detecting unit 18 detects this drive signal, counts an integrated time of the drive signal, and stores the integrated time in the memory. On the other hand, a deterioration level of a toner corresponding to an operation time of the developing unit 4 is arranged in a table in advance. The integrated time in the memory and the deterioration level of the toner are compared to determine a level of exposure energy control. At this point, an exposure energy control signal is sent to a laser driver 20 of an LD control board, whereby modulation of exposure energy is performed.

Figure 5:
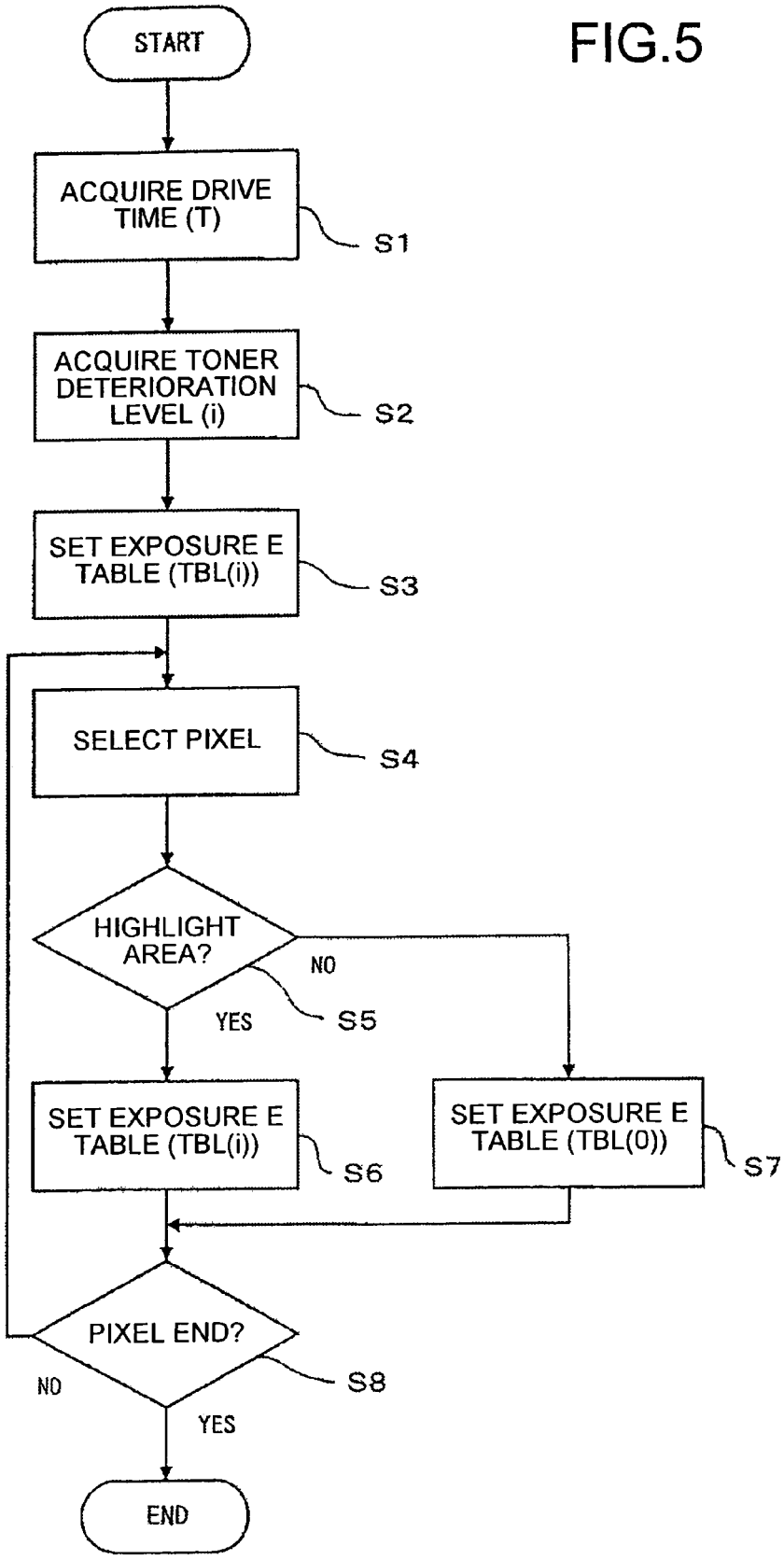
FIG. 5 is a flowchart of an example of a processing operation of the image forming apparatus according to the invention.
Figure 6:
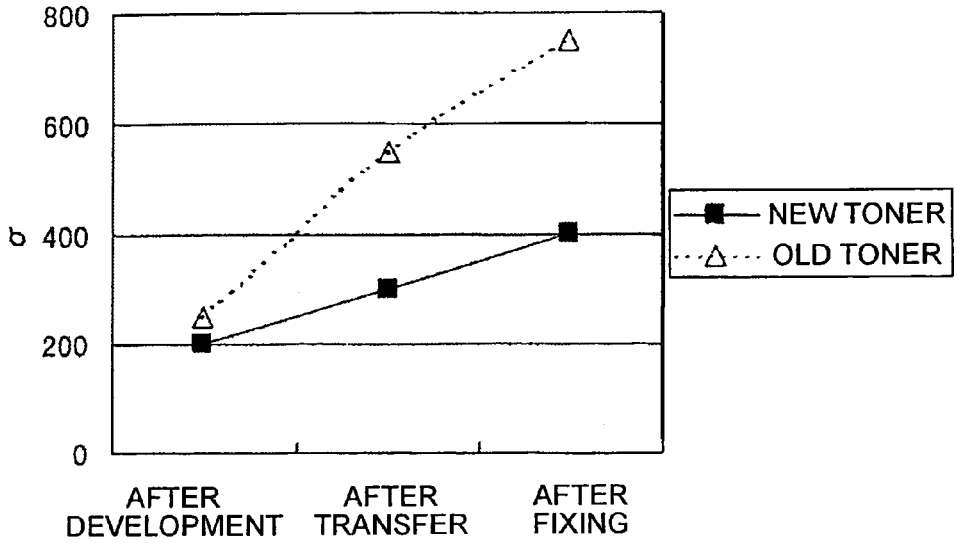
FIG. 6 is a diagram of a standard deviation of dot areas after development, after transfer, and after fixing at the time when an initial toner and an aged toner are used.
Figure 7A:
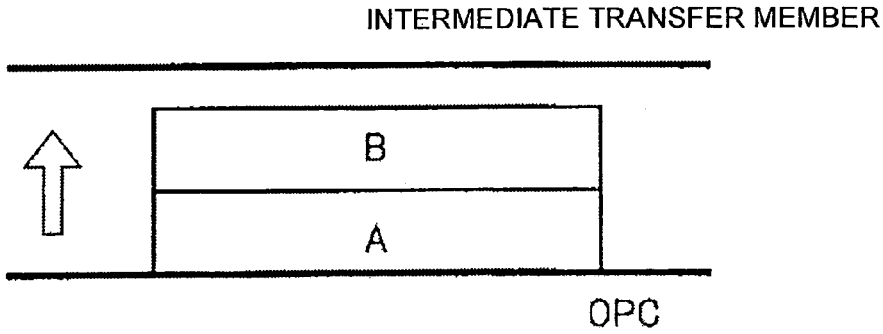
FIGS. 7A and 7B are diagrams explaining states at the time when a deposited toner on a photosensitive member is transferred onto an intermediate transfer member as models.
Figure 7B:
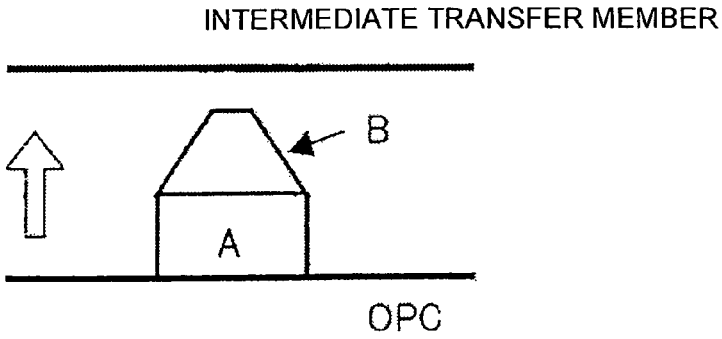

The processing described above is shown in a flowchart in FIG. 5. First, the image forming apparatus acquires an integrated development drive time (T) (S1). The image forming apparatus judges a toner deterioration level (i) according to the development drive time (T) (S2). This level is, for example, an extraneous additive burying level in five stages, and a relation of the level with the development drive time is already obtained. Note that this relation greatly depends on a developing unit in use and a toner. The image forming apparatus allocates a table at the time when exposure energy modulation is performed (TBL(i)) according to the toner deterioration level (S3). Next, the image forming apparatus selects a pixel in an inputted image (S4). Thereafter, the image forming apparatus judges an area ratio of halftone portion dots for the inputted image (S5). Consequently, the image forming apparatus judges whether a corresponding pixel is a highlight portion. If the pixel is a highlight portion, the image forming apparatus sets exposure energy for the pixel in the table for exposure energy determined by the processing in S3 (TBL(i)) (S6). On the other hand, when the pixel is not a highlight portion, the image forming apparatus sets exposure energy in a usual table for exposure energy (TBL(0)) (S7). The image forming apparatus applies this processing to all pixels in the inputted image (S8).

Using the processing for exposure energy control, image formation was performed continuously by changing conditions for four items of an image resolution [dpi], the number of lines [lpi] of halftone processing, a toner volume average particle diameter [μm], and toner circularity to evaluate a change in an image quality. Conditions for three levels (A, B, and C) in the respective items at that point are shown in Table 1 below. Here, the image resolution represents main scanning×sub-scanning. The volume average particle diameter was measured by a Coulter counter (Multisizer 3: manufactured by Beckman Coulter Inc.). In addition, the circularity is defined by the following formula obtained by measuring a shape of toner particles using a flow-type particle image measuring device (FPIA).

Circularity=(peripheral length of a circle having the same area as a projected area of a particle)/(peripheral length of a projected image of a particle)

This circularity closer to 1.00 indicates that a particle is closer to a sphere.

Here, a quantity of deposited toner per a unit area of a single color solid image was set to 0.45 mg/cm$^2$. In an initial image, when this quantity of deposited toner exceeds 0.50 mg/cm$^2$, concerning an image quality, since crush of a toner image becomes larger in the fixing unit 9 to increase fluctuation in a dot image area, granularity worsens. In addition, an increase in a quantity of deposited toner is not preferable from the viewpoint of energy saving and a reduction in a load on the environment because toner consumption increases and large power consumption is required in the fixing unit 9 to secure a fixing property.

TABLE 1

| | Resolution [dpi] | Number of lines [lpi] | Particle diameter [micrometers] | Circularity |
|---|---|---|---|---|
| A | 1200 × 1200 | 240 | 4.0 | 0.98 |
| B | 1200 × 600 | 200 | 5.5 | 0.96 |
| C | 600 × 600 | 175 | 7.0 | 0.94 |

Next, as specific examples, images actually formed under the conditions of three levels (A, B, and C) were evaluated after ten thousand sheets were printed, thirty thousand sheets were printed, and fifty thousand sheets were printed. An evaluation item was granularity in a highlight portion, and the granularity was evaluated in four grades I, II, III, and IV from the best to the worst. III and IV were defined as unallowable levels. A list of evaluation results is shown in Table 2 below.

TABLE 2

| | Resolution | Number of lines | Particle diameter | Circularity | Granularity after ten thousand sheets were printed | Granularity after thirty thousand sheets were printed | Granularity after fifty thousand sheets were printed |
|---|---|---|---|---|---|---|---|
| Example 1 | A | A | A | A | I | I | I |
| Example 2 | A | A | B | B | I | I | II |
| Example 3 | A | B | B | B | I | I | II |
| Example 4 | B | A | B | B | I | I | II |
| Example 5 | B | B | B | B | I | II | II |
| Comparative example 1 | C | B | B | B | II | III | IV |
| Comparative example 2 | B | C | B | B | II | III | IV |
| Example 6 | B | B | A | A | I | I | II |
| Example 7 | B | B | A | B | I | I | II |
| Example 8 | B | B | B | A | I | I | II |
| Comparative example 3 | B | B | C | B | III | IV | IV |
| Comparative example 4 | B | B | B | C | II | III | IV |

As indicated in examples 1 to 5, when the-toner particle diameter was 5.5 micrometers or less and the circularity was 0.96 or more, in the levels in which the image resolution was 1200×1200 dpi and 1200×600 dpi and the number of lines was 240 lpi and 2.00 lpi, the granularity was in a satisfactory level after fifty thousand sheets were printed, and worsening in roughness in the highlight portion was not observed.

On the other hand, in a comparative example 1, when the image resolution was 600×600 dpi, the granularity did not reach the allowable level after three thousand sheets were printed. Therefore, it is impossible to control worsening in granularity with time even if the control of exposure energy in the invention is used unless the image resolution is 1200 dpi or more in at least the main scanning or the sub-scanning. In addition, in a comparative example 2, when the number of lines was 175 lpi, the granularity did not reach the allowable level after thirty thousand sheets were printed. Therefore, it is impossible to control worsening in granularity with time even if the control of exposure energy in the invention is used unless the number of lines in the halftone processing is at least 200 lpi or more.

As indicated in examples 6 to 8, when the image resolution was 1200×600 dpi and the number of lines was 200 lpi, in the levels in which the toner particle diameter was 5.5 micrometers and 4.0 micrometers and the toner circularity was 0.96 and 0.98, the granularity was in a satisfactory level after fifty thousand sheets-were printed, and worsening in roughness in the highlight portion was not observed.

On the other hand, in a comparative example 3, when the toner particle diameter was 7.0 micrometers, the granularity did not reach the allowable level after ten thousand sheets were printed, and roughness in the highlight portion was high. Therefore, it is impossible to control worsening in granularity for a long period of time even if the control of exposure energy in the invention is used unless the toner particle diameter is 6.0 micrometers or less. In addition, in a comparative example 4, when the circularity of a toner was 0.94, the granularity did not reach the allowable level after thirty thousand sheets were printed, and roughness in the highlight portion was high. Therefore, it is impossible to control worsening in granularity for a long period of time even if the control of exposure energy in the invention is used unless the toner circularity is 0.96 or more.

According to the invention, it is possible to always obtain a satisfactory image, in which granularity is not damaged in a highlight portion, regardless of a length of use of the image forming apparatus. In addition, since proper control is performed according to the length of use of the image forming apparatus, it is possible to use the image forming apparatus longer to realize a long life thereof. Consequently, it is possible to realize both a high image quality and a long life of the image forming apparatus. There is also an effect in a reduction in cost and a reduction in an environmental load.

Furthermore, according to the invention, since modulation of exposure energy leads to efficient control without increasing a quantity of toner consumption largely, it is possible to realize both a high image quality and a long life of the image forming apparatus.

Moreover, according to the invention, since modulation of exposure energy is applied to only a highlight portion, it is possible to perform control more efficiently without increasing a quantity of toner consumption of the entire image forming apparatus largely and realize both a high image quality and a long life of the image forming apparatus.

Furthermore, according to the invention, since modulation of exposure energy is performed according to modulation of light-emitting intensity of a laser, it is possible to concentrate energy more intensely without increasing a dot area compared with PWM modulation. This improves reproducibility of a highlight portion and makes it possible to maintain a high image quality for a long period of time.

Moreover, according to the invention, since it is possible to grasp a degree of deterioration of a toner directly according to a development operation time and obtain a correlation with a simple experiment even if constitutions of developing apparatuses or toners are different, it is possible to perform more accurate control. This makes it possible to realize both a high image quality and a long life of the image forming apparatus.

Furthermore, according to the invention, even when small dots are formed at a resolution as high as 1200 dpi, it is possible to maintain a high image quality for a long period of time without damaging granularity of a highlight portion.

Moreover, according to the invention, even when halftone processing is performed by a dither with a large number of lines to form small dots in a halftone, it is possible to maintain a high image quality for a long period of time without damaging granularity of a highlight portion.

Furthermore, according to the invention, even when a quantity of deposited toner is as low as 0.50 mg/cm$^2$ or less in a single color solid image, it is possible to realize both a high image quality and a long life of the image forming apparatus.

Moreover, according to the invention, even when a volume average particle diameter of a toner is as small as 6.0 micrometers, it is possible to maintain satisfactory granularity in an initial image for a long period of time.

Furthermore, according to the invention, since a toner with toner particles having higher sphericity is used, even when the toner tends to deteriorate with time, it is possible to maintain a high image quality for a long period of time.

Moreover, according to the invention, the image forming apparatus includes at leas one of the aspects of the invention described above and includes plural developing units, which have toners of different colors in the inside thereof, respectively. Thus, since reproducibility of highlight portions of the respective colors is improved in a color image forming apparatus, color reproducibility and gray balance at the time when colors are superimposed are improved, and granularity in the colors is also improved. In particular, reproducibility or the like of human skin colors in a photographic image, which is important in a color image quality, is stabilized. In addition, since it is possible to create images with a small quantity of deposited toner in the developing apparatuses of the respective colors, it is possible to realize a significant reduction in a quantity of toner as the color image forming apparatus as a whole.

Furthermore, according to the invention, control is performed at least in the developing unit using a black toner in which fluctuation in a quantity of deposited toner significantly affects granularity. This makes it possible to control worsening of granularity with time efficiently.

Moreover, according to the invention, at least one unit selected from the image carrier, the charging unit, the developing unit, and the cleaning unit is integrally supported with the process cartridge, and the process cartridge is detachably attachable to the image forming apparatus body. Thus, by using this process cartridge in the image forming apparatus of the structure according to any one of the aspects of the invention described above, it is possible to further extend a life cycle of the image forming apparatus. This makes it possible to reduce an environmental load according to energy saving and obtain a satisfactory image quality for a long period of time.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

an image carrier;

an exposing unit that exposes the image carrier to light to form an electrostatic latent image on the image carrier;

a developing unit that has at least a toner, and develops the electrostatic latent image formed on the image carrier as a toner image;

a transfer unit that transfers the toner image onto a recording medium;

a fixing unit that fixes the toner image transferred on the recording medium;

an exposure-energy modulating unit that modulates exposure energy of the exposing unit; and a development-time detecting unit that detects a drive signal to count an operation time of the developing unit, wherein the exposure-energy modulating unit modulates the exposure energy based on a result of detection by the development-time detecting unit.

2. The image forming apparatus according to claim 1, wherein the exposure energy is modulated in such a manner that the exposure energy per a unit pixel is larger than the exposure energy at a time of writing a solid image.

3. The image forming apparatus according to claim 1, wherein the exposure energy is modulated in a portion of an input image where an area ratio is equal to or less than 25%.

4. The image forming apparatus according to claim 1, wherein the modulating unit modulates a light-emitting intensity of a light source.

5. The image forming apparatus according to claim 1, wherein he development-time detecting unit integrates the operation time of the developing unit to calculate deterioration of the toner.

6. The image forming apparatus according to claim 1, wherein an image resolution in at least one of a main scanning direction and a sub-scanning direction is equal to or more than 1200 dots per inch.

7. The image forming apparatus according to claim 1, wherein number of lines of dither processing, as a pseudo halftone processing, is equal to or more than 200 lines per inch.

8. The image forming apparatus according to claim 1, wherein an amount of the toner transferred per a unit area of a single-color solid image is equal to or less than 0.50 mg/cm$^2$.

9. The image forming apparatus according to claim 1, wherein a volume average particle diameter of the toner is equal to or less than 6.0 micrometers.

10. The image forming apparatus according to claim 1, wherein a circularity of the toner is equal to or more than 0.96.

11. The image forming apparatus according to claim 1, wherein a plurality of developing units is prepared, and each of the developing units includes toners of different colors.

12. The image forming apparatus according to claim 11, wherein the development-time detecting unit detects the operation time of at least the developing unit including a black toner.

13. A process cartridge that is mounted on an image forming apparatus, wherein the image forming apparatus includes an image carrier;

an exposing unit that exposes the image carrier to light to form an electrostatic latent image on the image carrier;

a developing unit that has at least a toner, and develops the electrostatic latent image formed on the image carrier as a toner image;

a transfer unit that transfers the toner image onto a recording medium;

a fixing unit that fixes the toner image transferred on the recording medium;

an exposure-energy modulating unit that modulates exposure energy of the exposing unit; and a development-time detecting unit that detects a drive signal to count an operation time of the developing unit, the exposure-energy modulating unit modulates the exposure energy based on a result of detection by the development-time detecting unit, and the process cartridge supports the image carrier and at least one of a charging unit, the developing unit, and a cleaning unit integrally, and is detachably mounted on a main body of the image forming apparatus.

* * * * *